United States Patent [19]

Miller et al.

[11] Patent Number: 4,529,191

[45] Date of Patent: Jul. 16, 1985

[54] DOORWAY MOUNTED HORIZONTAL BAR

[75] Inventors: Jack V. Miller, Sierra Madre; Stephen T. Blosser, Monrovia, both of Calif.

[73] Assignee: Gravity Guidance, Inc., Duarte, Calif.

[21] Appl. No.: 473,081

[22] Filed: Mar. 7, 1983

[51] Int. Cl.[3] ..... A63B 1/00

[52] U.S. Cl. ..... 272/62; 211/123; 272/900

[58] Field of Search ..... 272/112, 900, 63, 62, 272/93, 109; 211/105.1, 105.2, 123; D21/191; 108/149; 128/71; 248/201, 225.1, 216.4

[56] References Cited

U.S. PATENT DOCUMENTS

| | | | |
|---|---|---|---|
| D. 197,076 | 10/1963 | Spackman et al. | D21/191 |
| 2,465,598 | 3/1949 | McAveney | 211/105.1 |
| 2,518,328 | 8/1950 | Janonis | 211/123 |
| 3,332,655 | 7/1967 | Van Buren | 108/149 |
| 4,405,127 | 9/1983 | Miller | 272/62 |
| 4,458,894 | 7/1984 | Dudley | 272/900 |

*Primary Examiner*—Richard J. Apley
*Assistant Examiner*—S. R. Crow
*Attorney, Agent, or Firm*—Zarley, McKee, Thomte, Voorhees & Sease

[57] ABSTRACT

The horizontal bar includes tubular members freely telescopically interconnected having lateral extending ends depending to outward facing U-shaped members having sufficient width to be disposed about the respective sides of a doorway, and to have frictional engagement therewith. A pivotal link is attached to the base of each U-shaped member and is slidably engaged with a respective wedge-shaped receiving bracket at each side of the doorway. The pivotal links may be engaged with the respective receiving brackets in a depending orientation for a lower position of the horizontal bar or may be engaged with the brackets in an upstanding orientation for a higher position of the horizontal bar.

11 Claims, 6 Drawing Figures

DOORWAY MOUNTED HORIZONTAL BAR

BACKGROUND OF THE INVENTION

A chinning bar or horizontal bar for hanging either by the hands or the feet is needed that may be easily removed and safely installed in permanently installed small brackets; and that may be positioned at several heights above the floor, at least one of the heights being above the level of the door lintel, and is positioned in a spaced relationship from the doorway whereby the user may hang from the bar without danger of striking the doorway lintel. The bar should be quickly and easily installed and positioned for height, and should automatically adjust to fit various doorway widths.

Doorway mounted horizontal bars are presently known, as shown and described in a co-pending application, Ser. No. 376,513, now U.S. Pat. No. 4,405,127, and free-standing horizontal bars are well known as described for exercise and medical treatment by Martin, U.S. Pat. No. 3,380,447 as traction apparatus.

SUMMARY OF THE INVENTION

The horizontal bar is freely telescopically and longitudinally movable such that it will adapt to any doorway width by merely extending or contracting the bar. At both ends of the horizontal bar depending portions extend generally downwards to outward-facing U-shaped members and engaging with the sides of the doorway and having frictional contact therewith. The base of each U is generally horizontal and normal to the vertical plane of the horizontal bar, and the outward-facing legs of each U are parallel to the horizontal bar. A pivoting link is attached the the base of each U and is rotatable between depending and upstanding orientations. The distal end of each pivoting link is provided with a flat disc which is engaged with a respective receiving bracket attached to the side of the doorway. Each receiving bracket is provided with a wedge-shaped internal cavity so shaped and sized as to receive and retain the pivoting link disc downwardly wedged therein, and to release the pivoting link disc upon the application of sufficient upwards force.

The doorway mounted horizontal bar is installed in the doorway by first attaching a receiving blanket to each side of the inward-facing surfaces of the doorway, with the larger ends of the brackets facing upwards. The horizontal bar is telescopically collapsed to its shortest length and placed within the doorway. The telescoped bar is then extended with the outward-facing U-shaped members engaging the respective sides of the doorway. The discs of the pivoting links are engaged into the respective wedge-shaped cavities of the receiving brackets.

As a load is applied to the horizontal bar it moves downwards slightly and tightens the pivoting link discs into the wedge-shaped cavities of the receiving brackets, permitting the pivoting links to pivotally support the bases of the U-shaped members engaged with the sides of the doorway. Downward forces on the horizontal bar apply rotational moments to the U-shaped members and causing the legs of each U to clamp inwards on the wall surfaces of each side of the doorway and create a frictional lock within the doorway at the termination of the downward motion of the horizontal bar. Any additional loads having downwards components that may be applied to the horizontal bar through hanging, chinning or other exercises will serve to increase the wedging of the discs of the pivoting links into the respective brackets, and additionally will generate further friction between the U-shaped members and the doorway, whereby the apparatus becomes increasingly secure with additional applied loads.

In order to remove the apparatus from the doorway the horizontal bar is lifted slightly to release the frictional clamping on the doorway. Then an upward force applied to each U-shaped member will release the pivoting link disc from each respective receiving bracket whereby the horizontal bar may be telescoped out of engagement with the doorway sides and removed.

During installation the pivoting links may be oriented upstanding from the base of the U members, whereby the links are supported depending from the receiving brackets and the horizontal bar is positioned in a relatively low height above the floor. If desired the pivoting links may be oriented depending from the base of the U members, whereby the links are supported upstanding from the receiving brackets and the horizontal bar is positioned in a relatively high location above the floor.

DESCRIPTION OF THE PREFERRED EMBODIMENT

Figure 1:
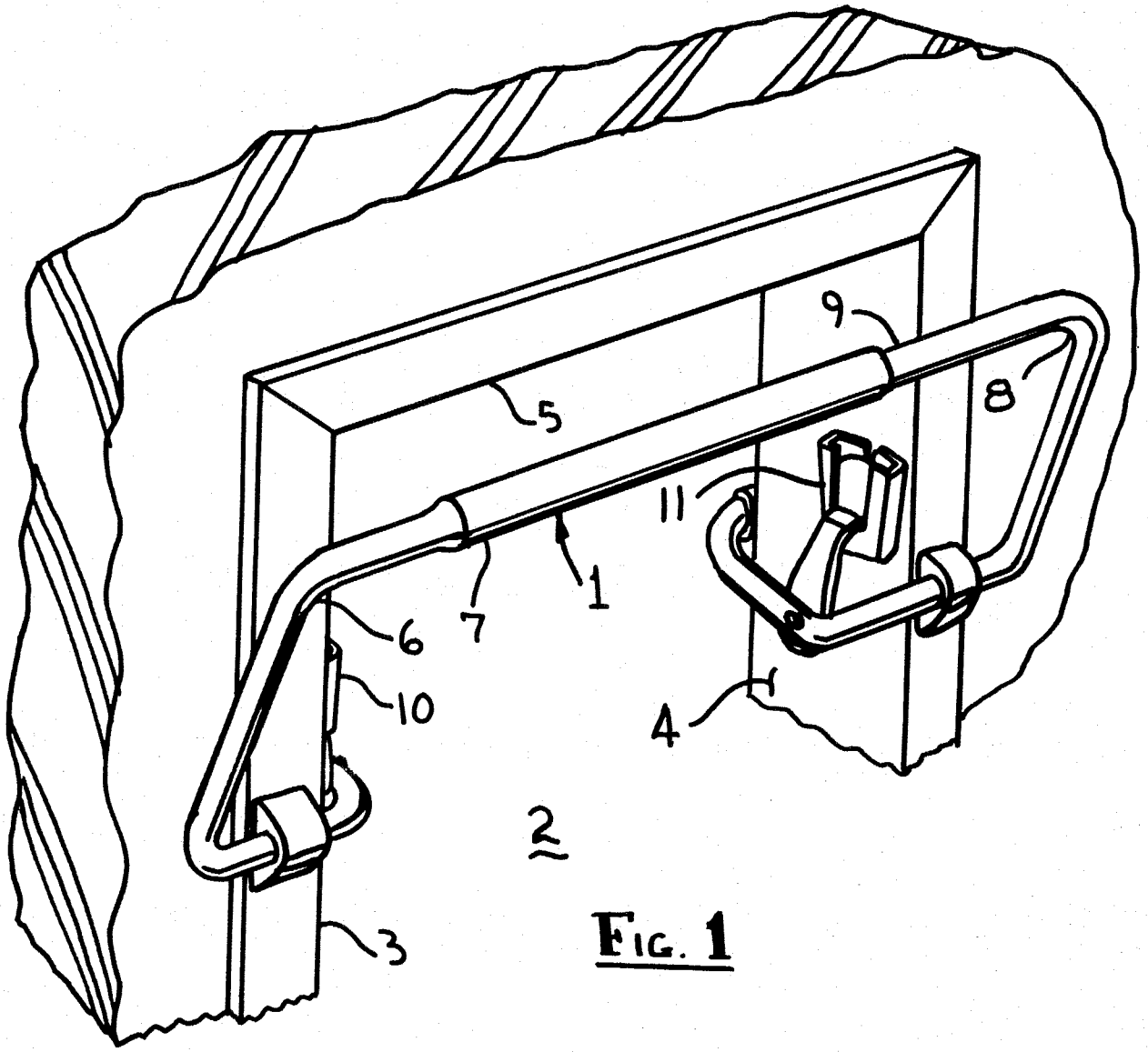
FIG. 1 is a perspective view of the horizontal bar mounted in a doorway.

The horizontal bar of this invention is referred to generally as 1 in FIG. 1 and is shown installed within a doorway 2 having sides 3 and 4 and a lintel 5. Bar 1 comprises generally two halves a right half 6 including tubular bar 7, and a left half 8 including a telescoping bar 9 slidably disposed within tubular bar 7. Side 3 of doorway 2 is provided with a receiving bracket 10 and side 4 of doorway 2 is provided with a receiving bracket 11.

Figure 2:
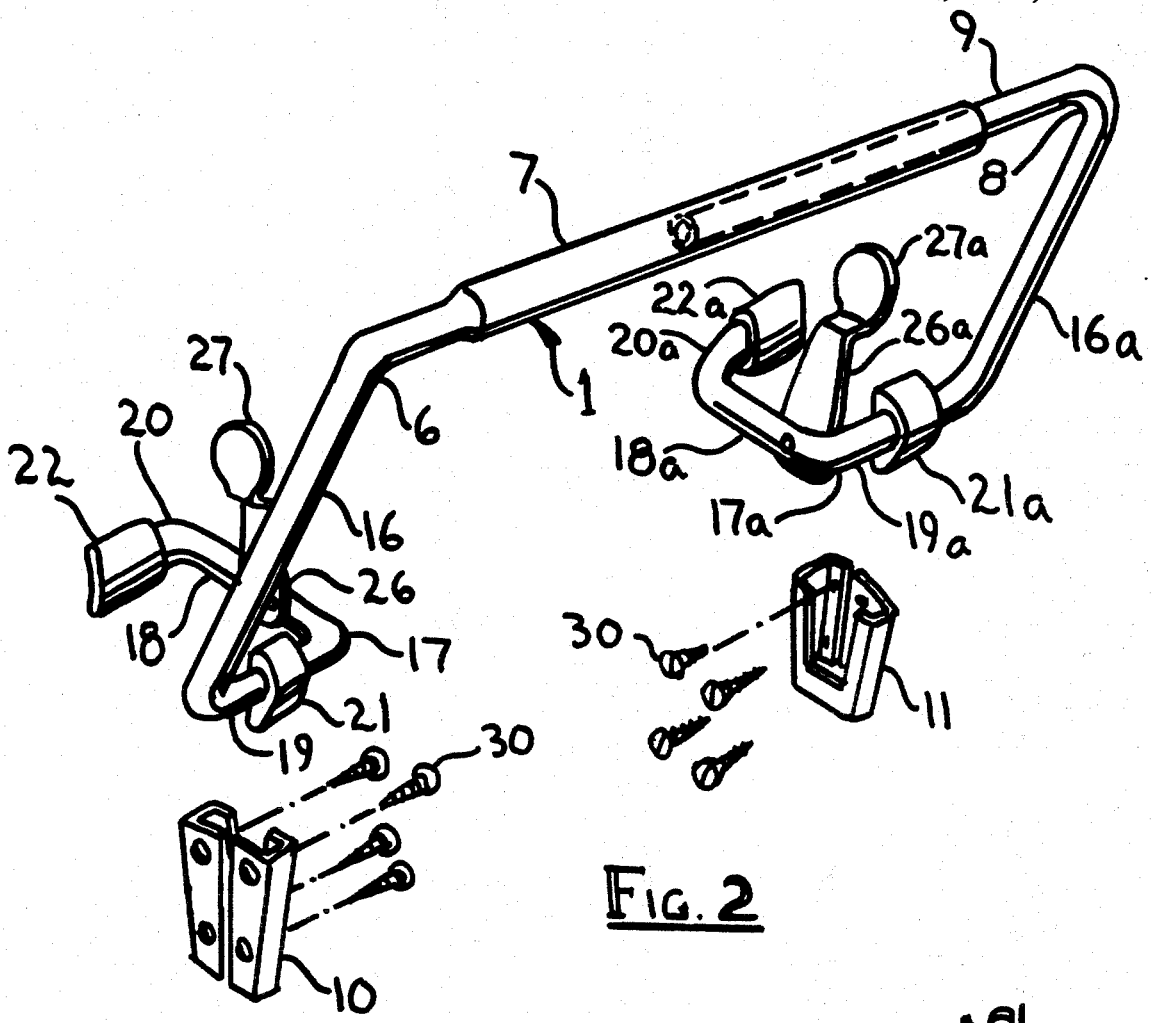
FIG. 2 is a perspective view of the horizontal bar of FIG. 1.

In FIG. 2 the horizontal bar 1 is shown with telescoping bar 9 of right half 8 slidably disposed within tubular bar 7 of left half 6, thereby providing a variable width to accomodate most doorways. The left half 6 has a depending portion 16 which terminates in a U-shaped member 17. U-shaped member 17 comprises a base 18, a front leg 19 and a rear leg 20. A resilient pad 21 envelopes leg 19 and a resilient pad 22 envelopes leg 20 to prevent marring of the door frame under load. A link 26 is pivotally attached to base 18 and is provided with a disc 27 at its distal end. Similarly the right half 8 has a depending portion **16*a* which terminates in a U-shaped member 17*a*. U-shaped member 17*a* comprises a base 18*a*, a front leg 19*a* and a rear leg 20*a*. A resilient pad 21*a* envelopes leg 19*a* and a resilient pad 22*a* envelopes leg 20*a* to prevent marring of the door frame under load. A link 26*a* is pivotally attached to base 18*a* and is provided with a disc 27*a* at its distal end. Disc 27 of the right half 6 slides vertically down into the receiving bracket 10, which is attachable to a door frame with screws 30. Similarly disc 27***a* of the left half 8 also slides vertically down into the receiving bracket 11, which is attachable to a door frame with screws 30.

Figure 3:
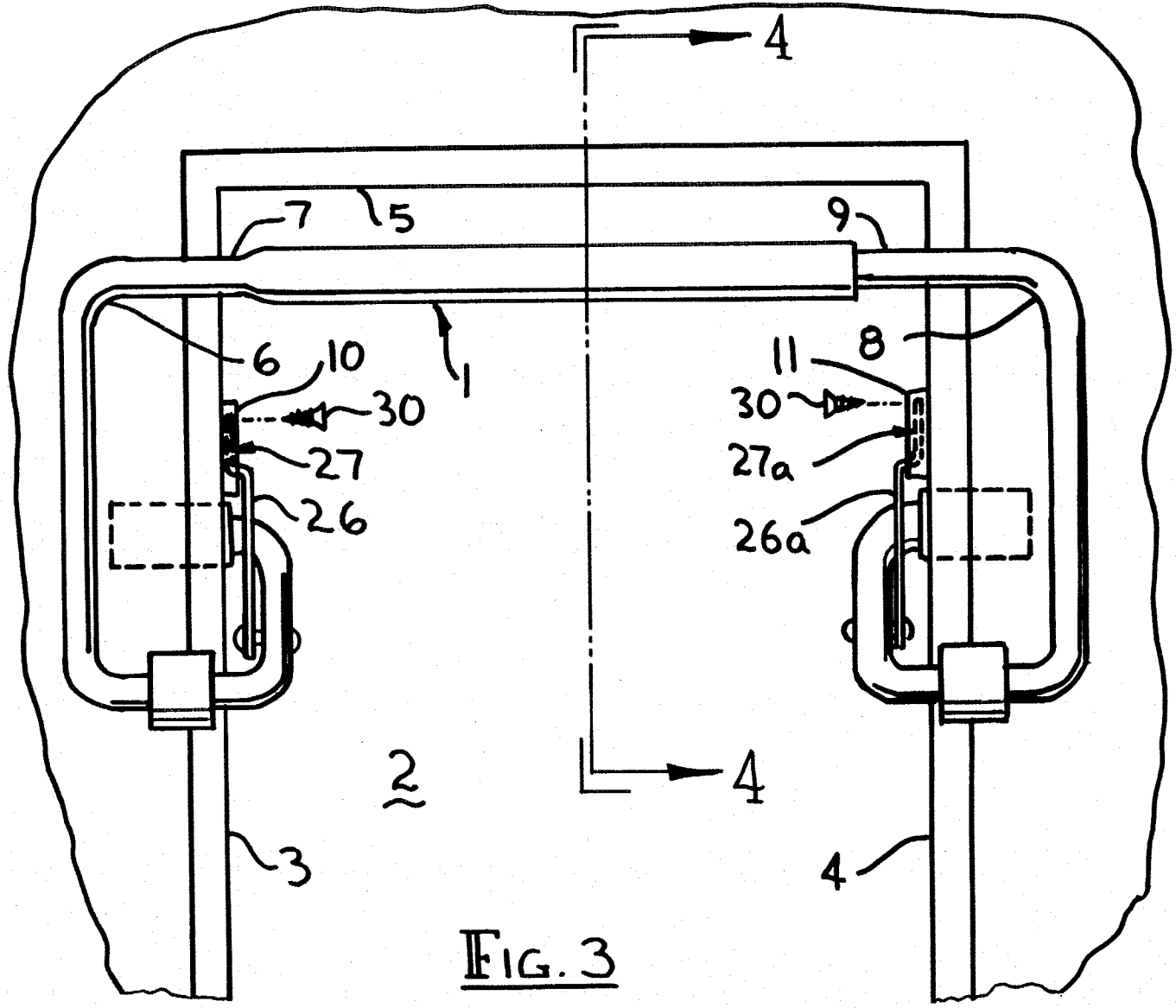
FIG. 3 is a front elevation view of the horizontal bar mounted in a doorway.

In FIG. 3 the horizontal bar 1 is shown having the left half 6 and the right half 8 extended slidably to fit between sides 3 and 4 of doorway 2, with the horizontal bar parallel to the doorway lintel 5. Disc 27 of pivoting link 26 is engaged into receiving bracket 10, which is in turn fastened to doorway side 3 with a number of screws 30. Similarly, disc 27*a* of pivoting link 26*a* is engaged into receiving bracket 11, which is in turn fastened to doorway side 4 with a number of screws 30.

Figure 4:
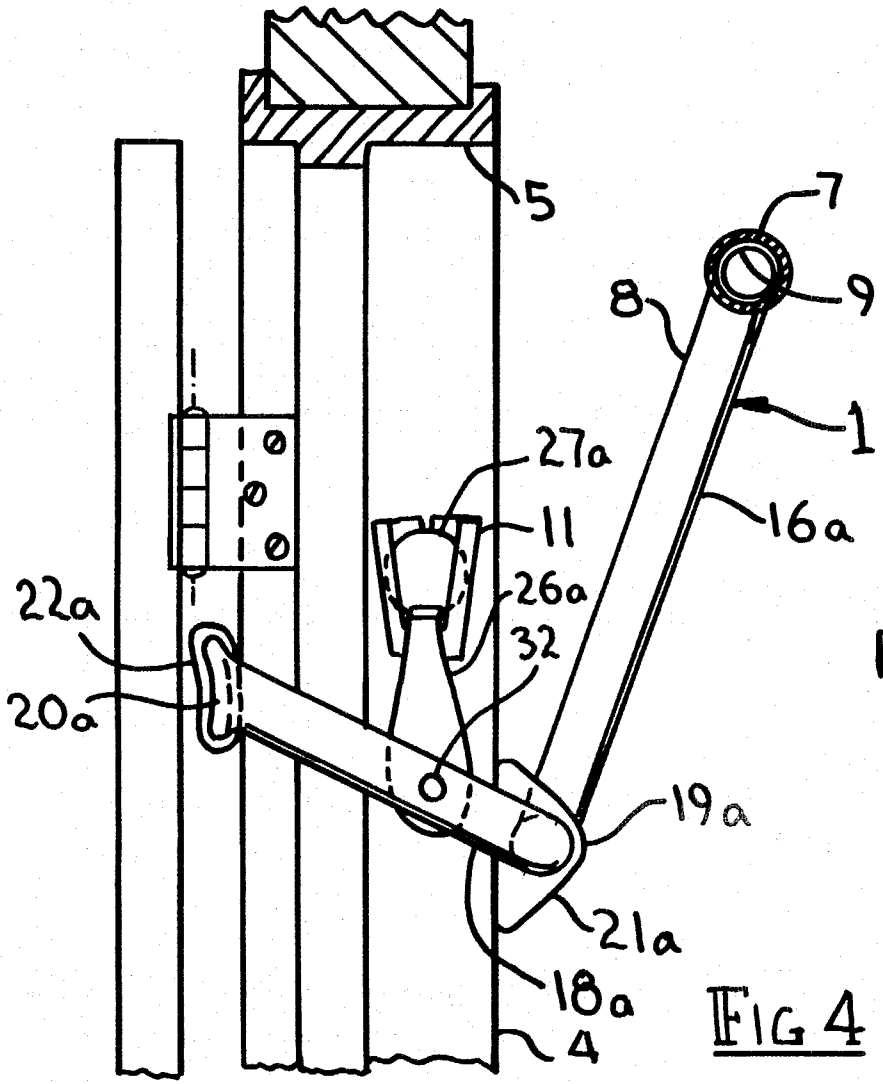
FIG. 4 is a cross-sectional view taken along the line 4—4 of FIG. 3.

In FIG. 4 the horizontal bar 1 is shown having the telescoping bar 9 of right half 8 disposed within the tubular bar 7 of left half 6. Depending portion 16*a* is contiguous with front leg 19*a*, disposed within resilient pad 21*a*; the front leg 19*a* being also contiguous with base 18*a*, which is in turn contiguous with rear 20*a* disposed within resilient pad 22*a*. Pivoting link 26*a* is attached to base 18*a* with a fastener 32, and disc 27*a* of link 26*a* is slidably disposed within the wedge-shaped receiver bracket 11.

Figure 5:
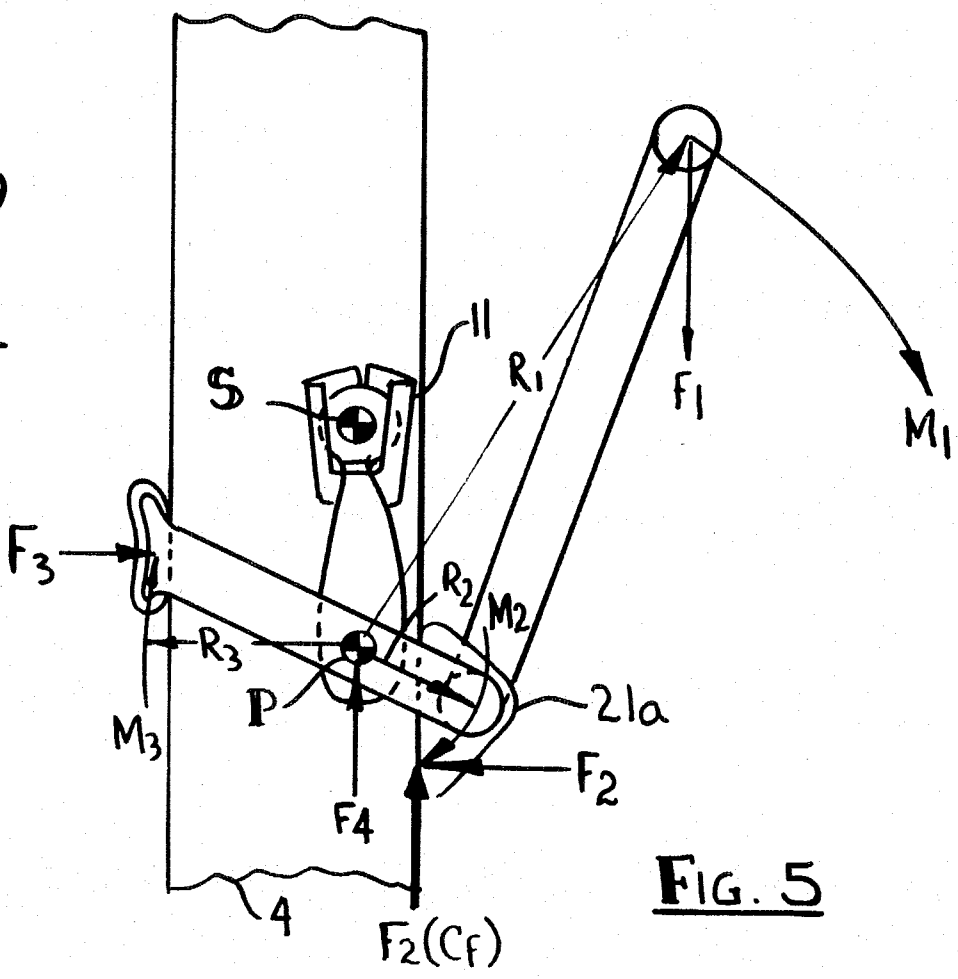
FIG. 5 is a force diagram showing the loads applied in the apparatus of FIG. 4.

In FIG. 5 the use of the bar provides a hanging weight force $F_1$ which generates an moment $M_1$ applied at radius $R_1$. This in turn applies a moment $M_2$ at radius $R_2$ about pivot point P, which is supported with force $F_4$ from the suspension point S. Moment $M_3$ is also created about point P at radius $R_3$, also applying force $F_3$. Since the pivoting link 26*a* is hinged at both point P and point S, point P will move to the location where force $F_2$ equal force $F_3$. The resilient pad 21*a* has force $F_2$ applied, so the supporting force provided by the doorway side 4 is $F_2$(Cf) where Cf is the frictional coefficient between pad 21*a* and doorway side 4. Therefore the load $F_1$ is supported by the combination of $F_2$ and $F_4$, and any increase in the load $F_1$ will result in a proportional increase in supporting load $F_2$. The load diagram described is for the right hand side of the apparatus, and a mirror image of the load conditions will also exist for the left hand side.

Figure 6:
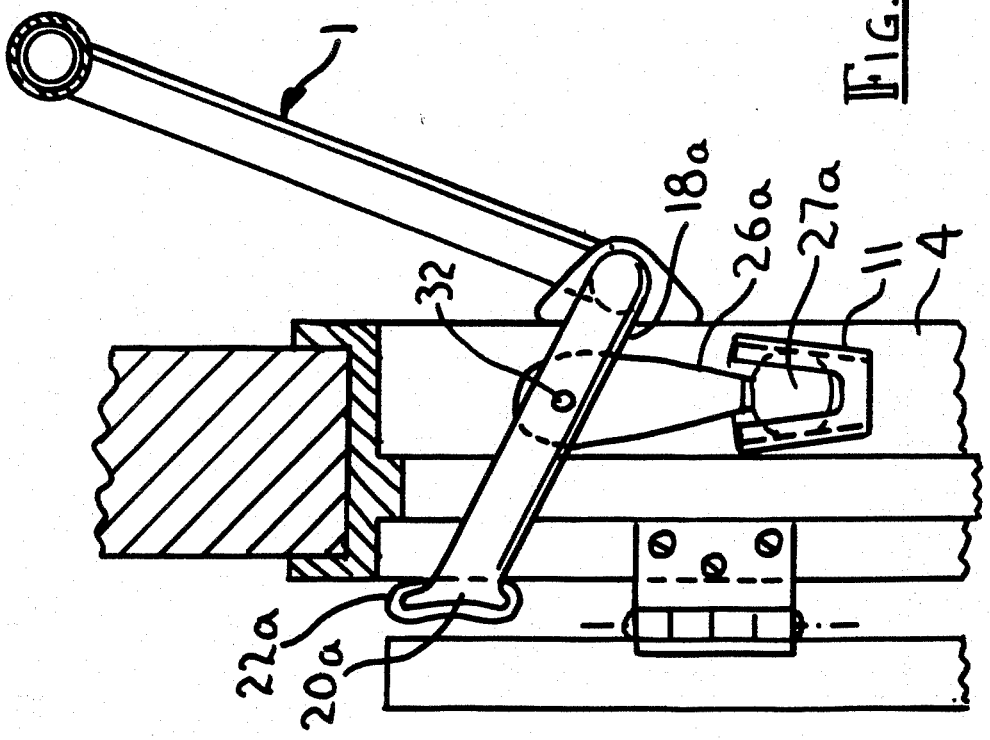
FIG. 6 is an alternate orientation of the horizontal bar providing a higher elevation.

In FIG. 6 the horizontal bar 1 may be seen installed with the pivoting link 26*a* depending from base 18*a*, with disc 27*a* engaged in wedge-shaped receiver bracket 11, whereby fastener 32 supporting base 18*a* provides a higher elevation for the horizontal bar than that shown in FIG. 4.

Thus it may be seen that the horizontal bar according to the invention will provide an extremely secure mounting that is self-clamping and is adjustable in elevation for users of various heights. The bar is automatically adjusting for a range of doorway widths, and will further self-adjust to match various door frame thickness.

In FIG. 6 and preceding figures rear leg 20*a* is seen to have a flat configuration which is generally co-planar with the surface of the doorway side 4. This permits leg 20*a* and the enveloping pad 22*a* to pass between the door frame and an open hinged door to provide the necessary support for the clamping action with broad contact eares that preclude damage to a door frame during vigorous exercise on the horizontal bar.

We claim:

1. A doorway mounted horizontal bar comprising:

a first member horizontally oriented near the lintel of a doorway and having laterally extending free ends, a depending member extending generally downwards from each end of said first member and terminating in respective outward-facing U-shaped members said U-shaped members each having a pair of spaced apart legs and an interconnecting web, said legs of each U-shaped member being disposed on opposite sides of said doorway with said interconnecting web being in close proximity to the respective side of said doorway;

a bracket attachable to the doorway sides in close proximity to each respective U-shaped member; and a pivotal attachment means joining each bracket to the respective U-shaped member and providing vertical support for the U-shaped members when said U-shaped members are engaged about the respective doorway sides.

2. The structure of claim 1 in which each of the telescoping tube members is a single piece of tubing contiguously from the telescoping tube through the depending member and including the U-shaped member.

3. The structure of claim 1 in which the doorway side brackets have part-receiving recesses and the pivotal attachment means are provided with parts slidably engaged into said recesses.

4. The structure of claim 3 in which the recesses are wedge-shaped receivers and the pivotal attachment parts engaged therein are generally circular discs.

5. The structure of claim 1 in which the U-shaped members are provided with resilient pads at the points of contact with the sides of the doorway.

6. The structure of claim 1 in which the pivotal attachment means joining each doorway side bracket to the respective U-shaped member is an elongated link capable of pivotal movement both at the doorway side bracket and the respective U-shaped member.

7. The structure of claim 6 in which the elongated links are pivotal about their attachment points to the U-shaped brackets from an upstanding orientation to a depending orientation and are engageable with the respective doorway side brackets in either orientation.

8. The structure of claim 7 in which the doorway side brackets are in fixed height location and the height of the horizontal bar is changed by moving the pivotal links from upstanding to depending orientation.

9. The structure of claim 1 in which the legs of the U-shaped members are provided with a friction increasing surface at least at the points of contact with the doorway frame.

10. The structure of claim 1 wherein said first member includes a pair of freely slidable telescoping tube members.

11. The structure of claim 1 wherein said legs of each U-shaped member engage opposite sides of said doorway whereby downward force on said first member exerts rotational moments on said U-shaped members so as to cause said legs of each U-shaped member to clamp inwardly on the wall surface on each side of the doorway thereby creating a frictional lock of the structure within said doorway.

* * * * *